US010743378B2

(12) United States Patent
Tang et al.

(10) Patent No.: US 10,743,378 B2
(45) Date of Patent: Aug. 11, 2020

(54) SPLIT-TYPE MICROWAVE OVEN

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Xiangwei Tang, Foshan (CN); Chun Luan, Foshan (CN); Shengbin Fu, Foshan (CN); Xiantao Du, Foshan (CN); Feina Zhang, Foshan (CN); Minyong Liu, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 410 days.

(21) Appl. No.: 15/714,864

(22) Filed: Sep. 25, 2017

(65) Prior Publication Data

US 2018/0014366 A1 Jan. 11, 2018

Related U.S. Application Data

(63) Continuation of application No. PCT/CN2016/070189, filed on Jan. 5, 2016.

(30) Foreign Application Priority Data

Mar. 26, 2015 (CN) ..... 2015 1 0138068
Mar. 26, 2015 (CN) ..... 2015 1 0138128
(Continued)

(51) Int. Cl.
*H05B 6/64* (2006.01)
*F24C 7/02* (2006.01)
*H05B 6/76* (2006.01)

(52) U.S. Cl.
CPC ..... *H05B 6/6432* (2013.01); *F24C 7/02* (2013.01); *H05B 6/64* (2013.01); *H05B 6/6402* (2013.01); *H05B 6/76* (2013.01)

(58) Field of Classification Search
CPC ..... F24C 7/02; H05B 6/64; H05B 6/6402; H05B 6/6432; H05B 6/76
(Continued)

(56) References Cited

U.S. PATENT DOCUMENTS 4,752,663 A 6/1988 Meisel
4,775,770 A 10/1988 Fritz
(Continued)

FOREIGN PATENT DOCUMENTS

CN 1737431 A 2/2006
CN 200943889 Y 9/2007
(Continued)

OTHER PUBLICATIONS

Notification of Reason for Refusal, KR-10-2017-7029991, dated Dec. 13, 2018, 12 pages.
(Continued)

*Primary Examiner* — Dana Ross
*Assistant Examiner* — Joseph W Iskra
(74) *Attorney, Agent, or Firm* — Morgan, Lewis & Bockius LLP

(57) ABSTRACT

A split-type microwave oven comprises a first housing assembly, a second housing assembly, a microwave source module, a microwave shielding and choking member, and a detection device that is used for detecting whether a wave leakage occurs in a microwave heating resonant cavity. The second housing assembly is detachably disposed on the first housing assembly. The first housing assembly is provided with a first microwave shielding member, the second housing assembly is provided with a second microwave shielding
(Continued)

member, and the first microwave shielding member is suitable for defining, together with the second microwave shielding member, the microwave heating resonant cavity. The microwave source module is installed on one of the first housing assembly and the second housing assembly. The microwave shielding and choking member is located outside the microwave heating resonant cavity. The split-type microwave oven occupies a small space and is convenient to use.

8 Claims, 4 Drawing Sheets

(30) Foreign Application Priority Data

Mar. 26, 2015 (CN) ..... 2015 2 0177037 U
Mar. 26, 2015 (CN) ..... 2015 2 0177395 U

(58) Field of Classification Search
USPC ..... 219/737
See application file for complete search history.

(56) References Cited

U.S. PATENT DOCUMENTS

| | | | |
|---|---|---|---|
| 6,462,320 | B1 | 10/2002 | Fuls et al. |
| 2003/0121913 | A1 | 7/2003 | Hayami et al. |

FOREIGN PATENT DOCUMENTS

| | | | | |
|---|---|---|---|---|
| CN | 101493235 | | * | 7/2009 |
| CN | 101493235 | A | | 7/2009 |
| CN | 101806466 | A | | 8/2010 |
| CN | 102141258 | | * | 8/2011 |
| CN | 102141258 | A | | 8/2011 |
| CN | 102331008 | B | | 7/2013 |
| CN | 104748177 | A | | 7/2015 |
| CN | 104748178 | A | | 7/2015 |
| CN | 204534709 | U | | 8/2015 |
| CN | 204534710 | U | | 8/2015 |
| JP | H0213723 | A | | 1/1990 |
| JP | H088055 | A | | 1/1996 |
| JP | 2000500912 | A | | 1/2000 |
| JP | 2003203757 | A | | 7/2003 |
| KR | 20010084756 | | * | 9/2001 |
| RU | 2122338 | C1 | | 11/1998 |
| RU | 2124278 | C1 | | 12/1998 |
| RU | 2134495 | C1 | | 8/1999 |
| RU | 2521995 | C2 | | 7/2014 |
| TW | 200840980 | A | | 10/2008 |

OTHER PUBLICATIONS

Guangdong Midea Kitchen Appliances Mfg. Co. Ltd., Official Action, RU2017134349, dated Jul. 26, 2018, 11 pgs.
Guangdong Midea Kitchen Appliances Mfg. Co. Ltd., Requisition by the Examiner (Office Action), CA2,972,661, dated Apr. 23, 2018, 4 pgs.
Midea Group Co. Ltd., First Office Action, CN201510138068.0, dated Aug. 31, 2016, 12 pgs.
Midea, International Search Report and Written Opinion, PCT/CN2016/070189, dated Apr. 11, 2016, 23 pgs.

* cited by examiner

SPLIT-TYPE MICROWAVE OVEN

PRIORITY CLAIM AND RELATED APPLICATION

This application is a continuation application of PCT/CN2016/070189, entitled "SPLIT-TYPE MICROWAVE OVEN" filed on Jan. 5, 2016, which claims priority to Chinese Patent Application No. 201510138068.0, filed with the State Intellectual Property Office of the People's Republic of China on Mar. 26, 2015, and entitled "SPLIT-TYPE MICROWAVE OVEN", Chinese Patent Application No. 201520177037.1, filed with the State Intellectual Property Office of the People's Republic of China on Mar. 26, 2015, and entitled "SPLIT-TYPE MICROWAVE OVEN", Chinese Patent Application No. 201510138128.9, entitled "SPLIT-TYPE MICROWAVE OVEN", filed with the State Intellectual Property Office of the People's Republic of China on Mar. 26, 2015, and Chinese Patent Application No. 201520177395.2, filed with the State Intellectual Property Office of the People's Republic of China on Mar. 26, 2015, and entitled "SPLIT-TYPE MICROWAVE OVEN", all of which are incorporated herein by reference in their entirety.

FIELD

The present disclosure relates to a field of household appliances, more particularly to a split-type microwave oven.

BACKGROUND

There are two kinds of integrated microwave ovens in the market, one is an integrated microwave oven with a magnetron power source input, and the other one is an integrated microwave oven with a semiconductor power source input. The integrated microwave oven with the magnetron power source input mainly includes a microwave oven cavity, a waveguide, a magnetron power source, a high-voltage electric power supply and a base plate. The magnetron power source is fixed to the waveguide, the waveguide is fixed with the microwave oven cavity through welding or riveting, and the high-voltage electric power supply is fixed on the base plate. The integrated microwave oven with the semiconductor power source input mainly includes a microwave oven cavity, a waveguide, a semiconductor microwave feed device, a coaxial cable, a semiconductor power source, and a direct-current electric power supply. The semiconductor power source is coupled with the semiconductor microwave feed device through the coaxial cable, the semiconductor power source is fixed on a base plate, and the waveguide is fixedly connected to the microwave oven cavity through welding or riveting.

In the related art, no matter for the integrated microwave oven with the magnetron power source or the integrated microwave oven with the semiconductor power source, the microwave oven cavity, the power source and the electric power supply thereof are integrated together, such that the whole machine has high integration, but large volume and weight, and thus it is not easy to place and move the microwave oven on a kitchen stove.

SUMMARY

Embodiments of the present disclosure seek to solve at least one of the problems existing in the related art to at least some extent. To this end, embodiments of the present disclosure provide a split-type microwave oven, which has advantages of small space occupation and convenient use.

The split-type microwave oven according to embodiments of the present disclosure includes: a first housing assembly and a second housing assembly, in which the second housing assembly is detachably disposed on the first housing assembly, the first housing assembly is provided with a first microwave shielding member, the second housing assembly is provided with a second microwave shielding member, and the first microwave shielding member is configured to define a microwave-heating resonant cavity together with the second microwave shielding member; a microwave source component mounted to one of the first housing assembly and the second housing assembly, in which the microwave source component includes a control unit, a power source, an electric power supply and an electromagnetic waveguide, the electromagnetic waveguide is configured to guide a microwave into the microwave-heating resonant cavity, and the control unit, the electric power supply and the electromagnetic waveguide are connected to the power source respectively; a microwave shielding and choking member located outside the microwave-heating resonant cavity and configured to prevent a microwave leakage when the first microwave shielding member and the second microwave shielding member define the microwave-heating resonant cavity; and a detection device connected to the control unit and configured to detect whether the microwave leakage occurs at the microwave-heating resonant cavity.

With the split-type microwave oven according to embodiments of the present disclosure, by using the second housing assembly detachable from the first housing assembly, the second microwave shielding member may be fitted with or detached from the first microwave shielding member, such that the microwave-heating resonant cavity for heating food may be defined when needed, and the second housing assembly may be stored away when there is no need for the split-type microwave oven to heat food, thus reducing the space occupation of the split-type microwave oven, improving the utilization of kitchen space, and satisfying the use requirement of the user.

According to some embodiments of the present disclosure, the microwave source component is mounted in the first housing assembly, and the first housing assembly is configured to be embedded in a supporting member or movably disposed on a supporting member.

According to some embodiments of the present disclosure, a portion of the first microwave shielding member is recessed towards an interior of the first housing assembly to define a groove, the split-type microwave oven further includes a carrying plate, the carrying plate is disposed at an opening of the groove and fitted with a side wall of the groove to define an enclosed cavity, and a portion of the electromagnetic waveguide extending outside a housing is located in the cavity.

According to some embodiments of the present disclosure, the second housing assembly is disposed on a closet, the microwave source component is mounted to the second housing assembly, the microwave source component further includes a coaxial cable, the coaxial cable is retractably connected between the power source and the electromagnetic waveguide, the second microwave shielding member is disposed on an end of the coaxial cable adjacent to the electromagnetic waveguide, the second housing assembly further includes a wave-transmitting material member, the wave-transmitting material member is disposed on a lower surface of the second microwave shielding member to define an accommodating cavity together with the second microwave shielding member, and the electromagnetic waveguide is located in the accommodating cavity.

According to some embodiments of the present disclosure, the first microwave shielding member is configured to be embedded in a supporting member or disposed on a surface of a supporting member.

According to some embodiments of the present disclosure, the first microwave shielding member is provided with a first clip member, the second microwave shielding member is provided with a second clip member configured to be fitted with the first clip member.

According to some embodiments of the present disclosure, at least one of the first microwave shielding member and the second microwave shielding member is a metal member.

According to some embodiments of the present disclosure, the second microwave shielding member is configured to have a hemispherical or cuboid shape which is hollow and has an open bottom.

According to some embodiments of the present disclosure, the microwave shielding and choking member is disposed in a remaining portion of an upper surface of the first housing assembly, the microwave shielding and choking member is formed as an annular member which is hollow and has an opening in a top thereof, when the second microwave shielding member is fitted with the first microwave shielding member, a lower surface of the second microwave shielding member encloses the opening.

According to some embodiments of the present disclosure, the microwave shielding and choking member is disposed on a lower end of the second microwave shielding member, the microwave shielding and choking member is formed as an annular member which is hollow and has an opening in a bottom thereof, when the second microwave shielding member is fitted with the first microwave shielding member, the first microwave shielding member encloses the opening.

According to some embodiments of the present disclosure, the power source is configured as a magnetron power source or a semiconductor power source.

According to some embodiments of the present disclosure, the detection device is configured as a sensor for detecting an amount of microwaves outside the microwave-heating resonant cavity.

According to some embodiments of the present disclosure, the detection device includes an emitter for emitting a microwave signal and a receiver for receiving a standing wave, when the second microwave shielding member is disposed on the first microwave shielding member to define the microwave-heating resonant cavity, the emitter is configured to emit the microwave signal into the microwave-heating resonant cavity, and the receiver is configured to receive the reflected standing wave.

Figure 1:
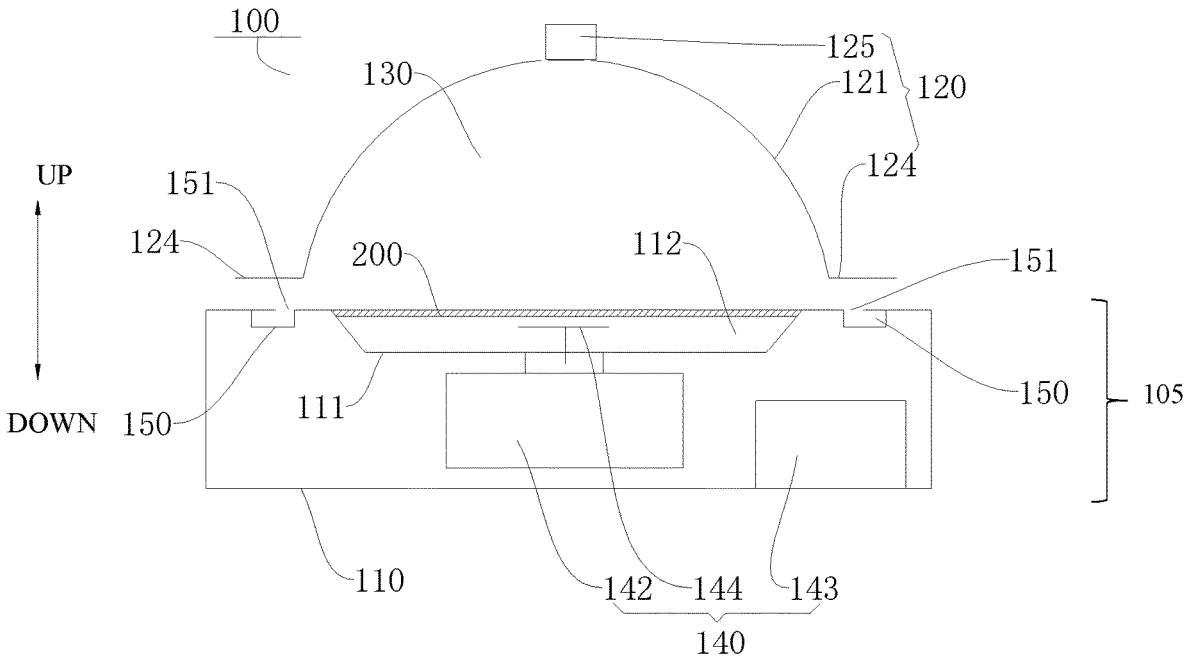
FIG. 1 is an exploded view of a split-type microwave oven according to some embodiments of the present disclosure.

REFERENCE NUMERALS split-type microwave oven 100, first microwave shielding member 110, groove 111, cavity 112, second housing assembly 120, second microwave shielding member 121, wave-transmitting material member 122, accommodating cavity 123, flanging 124, handle 125, microwave-heating resonant cavity 130, microwave source component 140, power source 142, electric power supply 143, electromagnetic waveguide 144, coaxial cable 145, microwave shielding and choking member 150, opening 151, carrying plate 200, supporting member 300, heated object 400, closet 500.

DETAILED DESCRIPTION

Embodiments of the present disclosure will be described in detail below, and examples of the embodiments are shown in accompanying drawings. The embodiments described herein with reference to drawings are explanatory, illustrative, and used to generally understand the present disclosure. The embodiments shall not be construed to limit the present disclosure.

A split-type microwave oven 100 according to embodiments of the present disclosure will be described below with reference to FIGS. 1 to 5.

As shown in FIGS. 1 to 5, the split-type microwave oven 100 according to embodiments of the present disclosure includes a first housing assembly 105, a second housing assembly 120, a microwave source component 140, a microwave shielding and choking member 150 and a detection device (not shown).

Specifically, the second housing assembly 120 is detachably disposed on the first housing assembly 105. For example, as shown in FIG. 1, the first housing assembly 105 may be placed on a supporting member 300, the supporting member 300 may be a table top or an operating bench of a kitchen stove herein, and the second housing assembly 120 and the first housing assembly 105 are detachably disposed from each other. The first housing assembly 105 is provided with a first microwave shielding member 110, the second housing assembly 120 is provided with a second microwave shielding member 121, and the first microwave shielding member 110 is adapted to define a microwave-heating resonant cavity 130 together with the second microwave shielding member 121. A heated object 400 (e.g. food, and so on) may be placed into the microwave-heating resonant cavity 130 to be heated. It may be understood that microwave cannot be transmitted outside the microwave-heating resonant cavity 130 by passing through the first microwave shielding member 110 and the second microwave shielding member 121.

When there is a need for removing the heated object 400 from the microwave-heating resonant cavity 130 or putting the heated object 400 into the microwave-heating resonant cavity 130, the second housing assembly 120 may be removed or placed away from the first housing assembly 105; when the heated object 400 is to be heated, the second housing assembly 120 is placed on the first housing assembly 105, such that the first microwave shielding member 110 and the second microwave shielding member 121 define the microwave-heating resonant cavity 130 together.

The microwave source component 140 is mounted to one of the first housing assembly 105 and the second housing assembly 120. That is to say, the microwave source component 140 may be mounted to the first housing assembly 105, or may be mounted to the second housing assembly 120. The microwave source component 140 includes a control unit, a power source 142, an electric power supply 143 and an electromagnetic waveguide 144. The electromagnetic waveguide 144 is adapted to guide the microwave into the microwave-heating resonant cavity 130, and the control unit, the electric power supply 143 and the electromagnetic waveguide 144 are connected to the power source 142 respectively. Thus, the electric power supply 143 may supply power to the power source 142, and the control unit may control the power source 142 to start or stop. The power source 142 may be a magnetron power source or a semiconductor power source 142.

When the second microwave shielding member 121 is fitted with the first microwave shielding member 110 to define the microwave-heating resonant cavity 130 and after the control unit controls the power source 142 to start, the microwave is transmitted into the microwave-heating resonant cavity 130 through a coaxial cable 145 and the electromagnetic waveguide 144. Under action of the first microwave shielding member 110 and the second microwave shielding member 121, the microwave cannot pass through the first microwave shielding member 110 and the second microwave shielding member 121, but can only be propagated into the microwave-heating resonant cavity 130 defined by the first microwave shielding member 110 and the second microwave shielding member 121, such that the food placed in the microwave-heating resonant cavity 130 may be heated.

When the second microwave shielding member 121 is fitted with the first microwave shielding member 110, the second microwave shielding member 121 and the first microwave shielding member 110 define the microwave-heating resonant cavity 130 together, but there may be a gap between the second microwave shielding member 121 and the first microwave shielding member 110. In order to prevent a microwave leakage at a junction of the second microwave shielding member 121 and the first microwave shielding member 110, a microwave shielding and choking member 150 may be disposed outside the microwave-heating resonant cavity 130. The microwave shielding and choking member 150 is located outside the microwave-heating resonant cavity 130 to prevent a microwave leakage from the microwave-heating resonant cavity 130. When the microwave-heating resonant cavity 130 is defined, the microwave shielding and choking member 150 may be disposed at the junction of the first microwave shielding member 121 and the second microwave shielding member 110. For example, as shown in FIGS. 1 to 5, the microwave shielding and choking member 150 is disposed at a lower end of the second microwave shielding member 121. Thus, the split-type microwave oven 100 may have a reasonable structure.

In order to further improve the safety of the split-type microwave oven 100, the split-type microwave oven 100 may include a detection device. The detection device may be used to detect whether the microwave leakage occurs at the microwave-heating resonant cavity 130, and the detection device may be connected to the control unit. It may be understood that a detection result of the detection device may be transmitted to the control unit, and the control unit may send out a corresponding control instruction according to the detection result. That is, when the lower end of the second microwave shielding member 121 is fitted with the first microwave shielding member 110 and the detection device detects that the microwave leakage occurs at the microwave-heating resonant cavity 130, the control unit turns off the power source 142, and thus the split-type microwave oven 100 cannot heat the food placed in the microwave-heating resonant cavity 130; when the lower end of the second microwave shielding member 121 is fitted with the first microwave shielding member 110 and the detection device detects that the microwave leakage does not occur at the microwave-heating resonant cavity 130, the control unit starts the power source 142, and thus the split-type microwave oven 100 may heat the food placed in the microwave-heating resonant cavity 130.

With the split-type microwave oven 100 according to some embodiments of the present disclosure, by using the second housing assembly 120 detachable from the first housing assembly 105, the second microwave shielding member 121 may be fitted with or detached from the first microwave shielding member 110, such that the microwave-heating resonant cavity 130 for heating food may be defined when needed, and the second housing assembly 120 may be stored away when there is no need for the split-type microwave oven 100 to heat food, thus reducing the space occupation of the split-type microwave oven 100, improving an utilization of kitchen space, and satisfying use requirements of a user.

Figure 2:
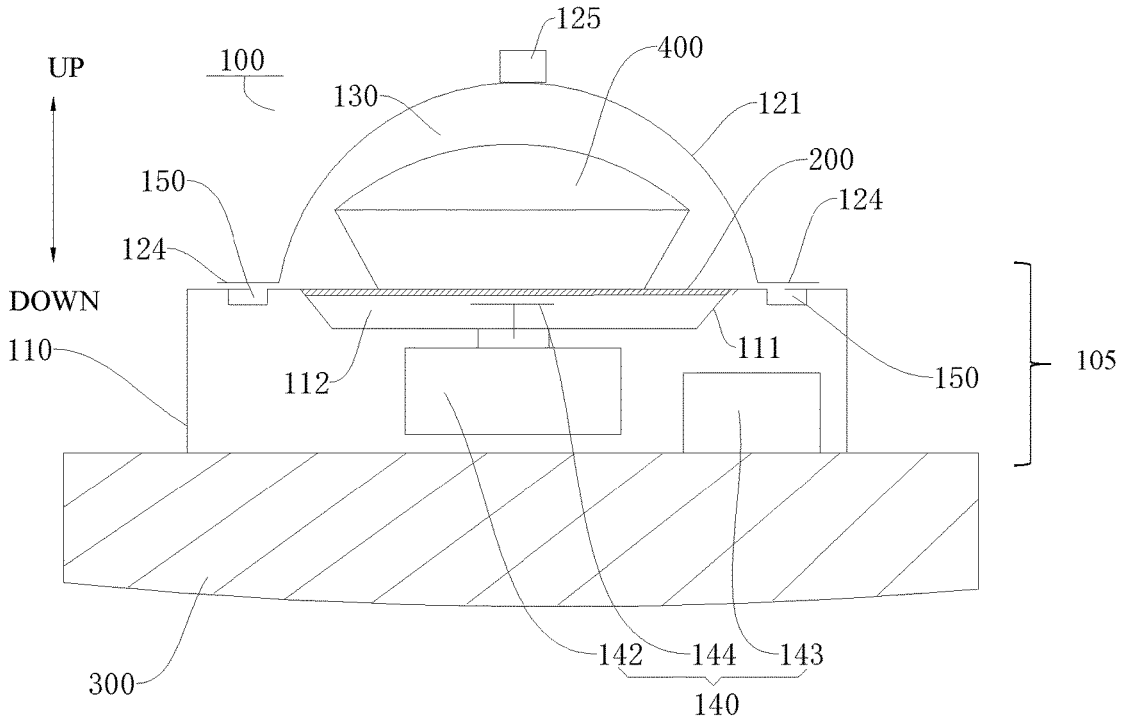
FIG. 2 is a schematic view of a split-type microwave oven according to some embodiments of the present disclosure, in which a first housing assembly is disposed on an upper surface of a supporting member.
Figure 3:
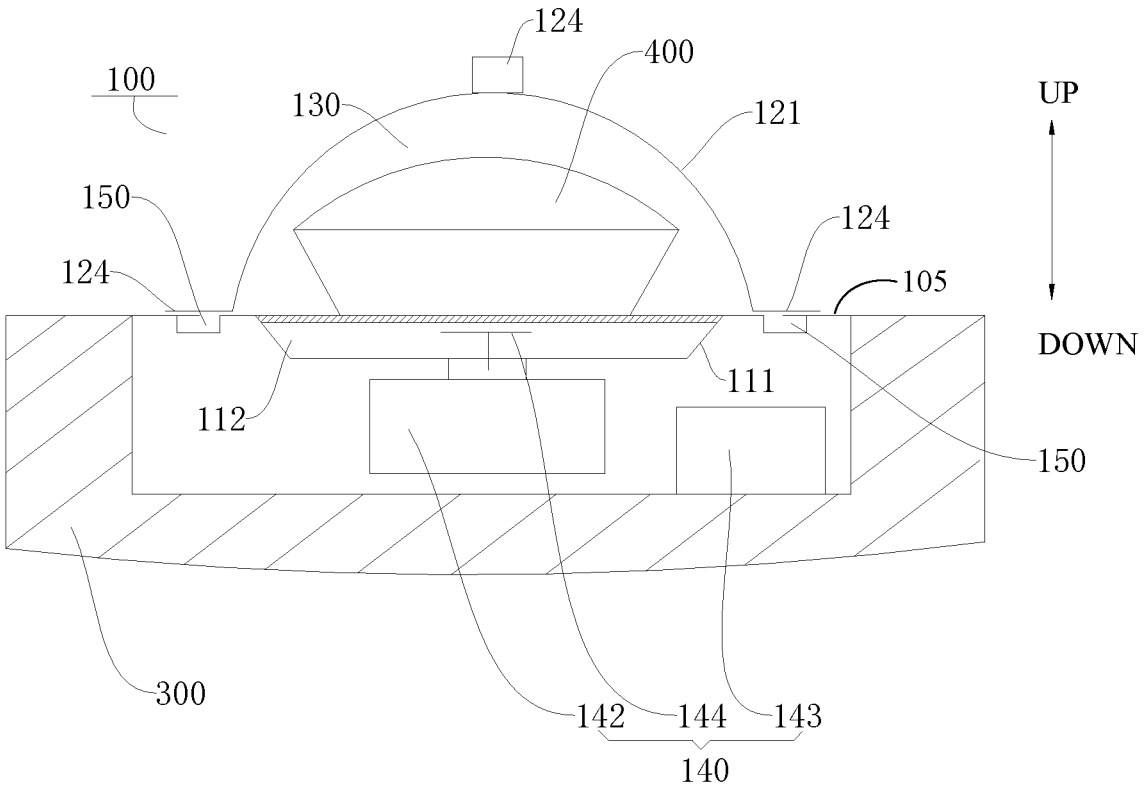
FIG. 3 is a schematic view of a split-type microwave oven according to some embodiments of the present disclosure, in which a first housing assembly is embedded in a supporting member, and an upper surface of a microwave source component is flush with an upper surface of the supporting member.

According to some embodiments of the present disclosure, as shown in FIG. 2, the microwave source component 140 is mounted in the first housing assembly 105, and the first housing assembly 105 is movably disposed on the supporting member 300. Herein, the supporting member 300 may be a table top or an operating top of the kitchen stove. Certainly, an arrangement of the first housing assembly 105 is not limited to this. For example, the first housing assembly 105 may also be embedded in the supporting member 300 (as shown in FIG. 3). Thus, the arrangement of the first housing assembly 105 is diversified, and the user may dispose the first housing assembly 105 according to practical requirements, thereby improving the satisfaction of the user. Further, in order to improve entire aesthetics of the split-type microwave oven 100, an upper surface of the first housing assembly 105 may be flush with an upper surface of the supporting member 300.

According to some embodiments of the present disclosure, as shown in FIGS. 1 to 3, a portion of the first microwave shielding member 110 is recessed towards an interior of the first housing assembly 105 to define a groove 111. As shown in FIGS. 1 to 3, the split-type microwave oven 100 further includes a carrying plate 200. The carrying plate 200 is disposed at an opening of the groove 111, and is fitted with a side wall of the groove 111, so as to define an enclosed cavity 112. A portion of the electromagnetic waveguide 144 extending out of a housing is located in the cavity 112. The carrying plate 200 is located in the microwave-heating resonant cavity 130 to carry the heated object 400 (e.g. the food, and so on).

It should be noted that the heated object 400 may be placed on an upper surface of the carrying plate 200, and the carrying plate 200 may be made of wave-transmitting materials, such that the microwave in the cavity 112 may be propagated into the microwave-heating resonant cavity 130. It may be understood that, when the food needs to be heated, the second microwave shielding member 121 may be fitted with the first microwave shielding member 110 to define the microwave-heating resonant cavity 130, the control unit starts the power source 142 to produce the microwave, and the microwave is transmitted into the cavity 112 through the electromagnetic waveguide 144, then further into the microwave-heating resonant cavity 130, so as to heat the food. When the split-type microwave oven 100 is not needed to be used, the second housing assembly 120 may be stored away to prevent the split-type microwave oven 100 from occupying the kitchen space, thus, not only satisfying the use requirement of the user, but also improving the utilization of the kitchen space.

In order to improve the appearance aesthetics of the first housing assembly 105, as shown in FIGS. 1 to 3, the upper surface of the carrying plate 200 is flush with a remaining portion of an upper surface of the first microwave shielding member 110. Herein, "a remaining portion of an upper surface of the first microwave shielding member 110" refers to a portion of the upper surface of the first microwave shielding member 110 except the groove 111. In order to evenly transmit the microwave into the microwave-heating resonant cavity 130, an end of the electromagnetic waveguide 144 located in the cavity 112 may be provided with an antenna or a stirring blade, such that the heated object 400 may be evenly heated to ensure a heating effect of the split-type microwave oven 100, and thus the use requirement of the user may be satisfied. According to an example of the present disclosure, the antenna or the stirring blade is rotatably disposed on the end of the electromagnetic waveguide 144. Thus, the evenness of microwave propagation is further improved.

Figure 4:
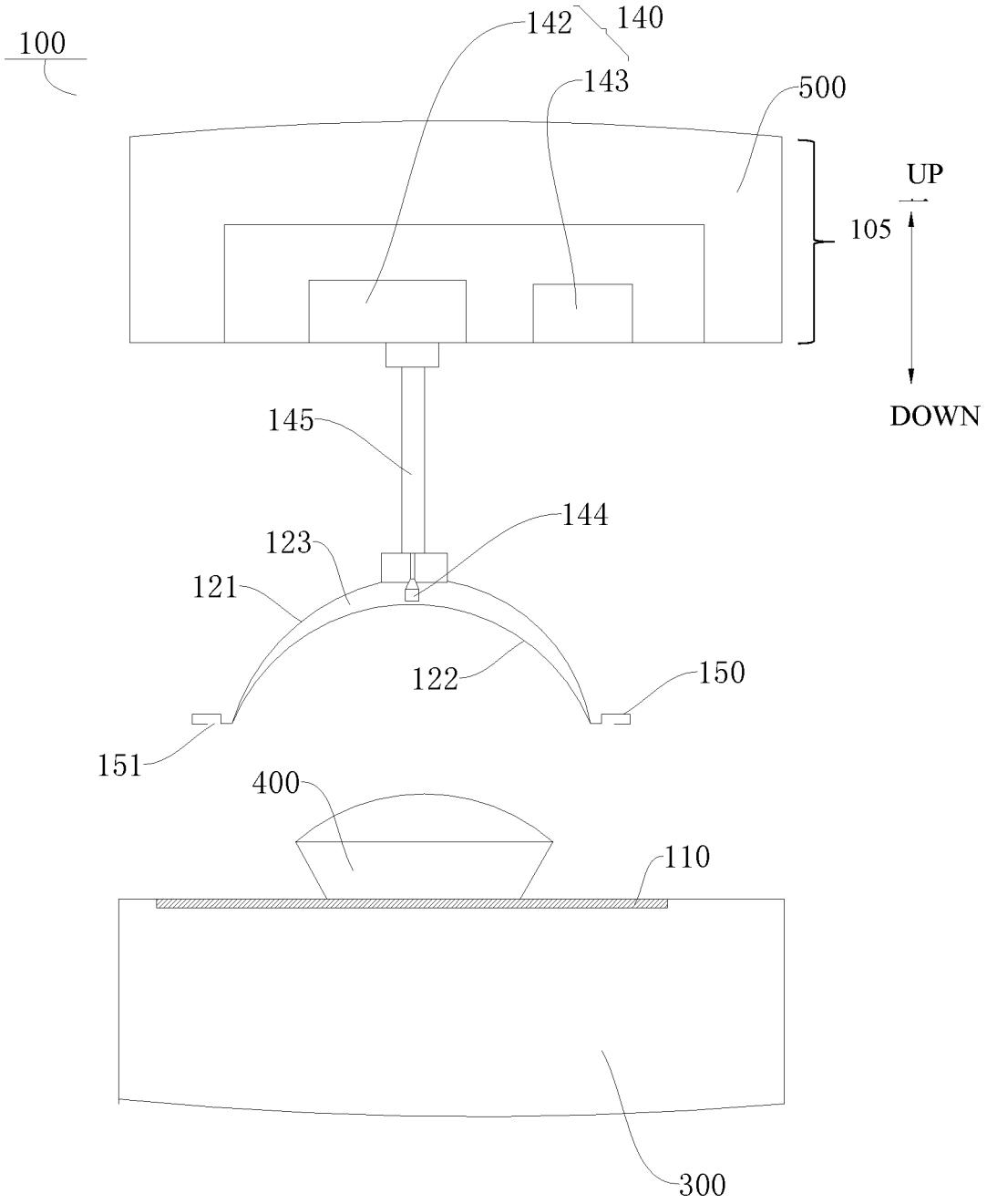
FIG. 4 is a front view of a split-type microwave oven according to some embodiments of the present disclosure, in which a second microwave shielding member is detached from a first microwave shielding member.
Figure 5:
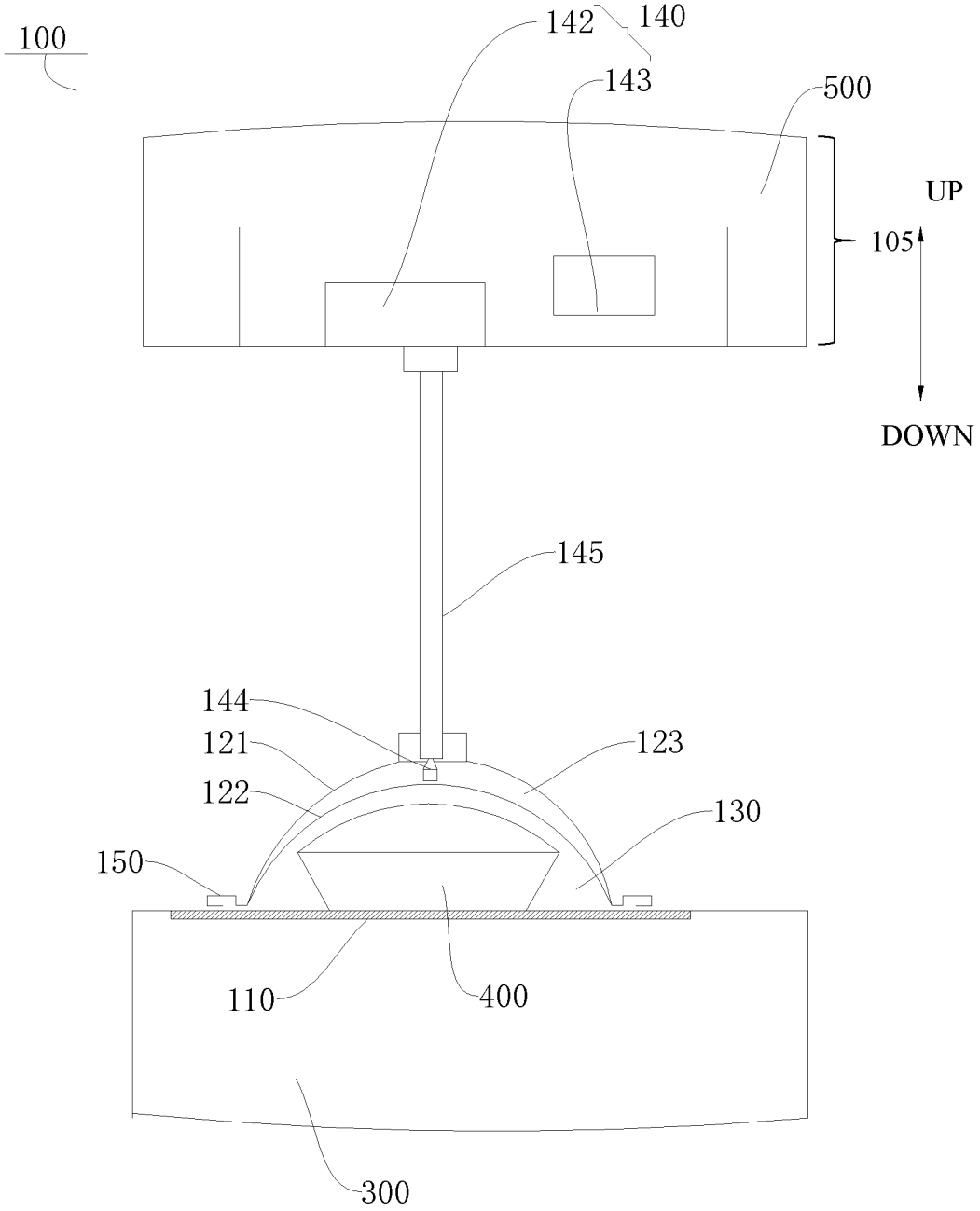
FIG. 5 is a front view of a split-type microwave oven according to some embodiments of the present disclosure, in which a second microwave shielding member is fitted with a first microwave shielding member to define a microwave-heating resonant cavity.

According to another embodiment of the present disclosure, as shown in FIGS. 4 and 5, the microwave source component 140 is mounted to the second housing assembly 120, and the microwave source component 140 further includes a coaxial cable 145. The coaxial cable 145 is retractably connected between the power source 142 and the electromagnetic waveguide 144, and the second microwave shielding member 121 is disposed on an end of the coaxial cable 145 adjacent to the electromagnetic waveguide 144. The second housing assembly 120 further includes a wave-transmitting material member 122, and the wave-transmitting material member 122 is disposed on a lower surface of the second microwave shielding member 121 to define an accommodating cavity 123 together with the second microwave shielding member 121. The electromagnetic waveguide 144 is located in the accommodating cavity 123.

It should be noted that the first housing assembly 105 may be disposed on the table top or the operating bench of the kitchen stove, the second housing assembly 120 may be fixed to a closet 500. The closet 500 is generally located at a high position, and the second housing assembly may be fitted with or detached from the first housing assembly 105 by the retractable coaxial cable 145, such that the first microwave shielding member 110 may be fitted with or detached from the second microwave shielding member 121.

For example, as shown in FIGS. 4 and 5, an upper end of the coaxial cable 145 is connected to the power source 142 of the microwave source component 140, and a lower end of the coaxial cable 145 is connected to the electromagnetic waveguide 144. The coaxial cable 145 is retractable in an up-and-down direction (i.e., the up-and-down direction shown in FIGS. 4 and 5), and the second microwave shielding member 121 is disposed on the lower end of the coaxial cable 145 and covers over the electromagnetic waveguide 144. The lower end of the second microwave shielding member 121 is adapted to be fitted with the first microwave shielding member 110 to define the microwave-heating resonant cavity 130.

It may be understood that when the coaxial cable 145 is stretched or retracted, the second microwave shielding member 121 may be driven to move in the up-and-down direction (i.e. the up-and-down direction as shown in FIGS. 4 and 5). When the coaxial cable 145 is stretched downward and drives the second microwave shielding member 121 to move downward, as shown in FIG. 5, the lower end of the second microwave shielding member 121 may be fitted with the first microwave shielding member 110, and the second microwave shielding member 121 may define the microwave heating cavity together with the first microwave shielding member 110. When the coaxial cable 145 is retracted upward and drives the second microwave shielding member 121 to move upward, as shown in FIG. 4, a cavity component may be stored away at a position adjacent to the microwave source component 140. The microwave source component 140 may be disposed on a mounting wall such as the closet 500, etc. That is to say, when the lower end of the second microwave shielding member is fitted with the first microwave shielding member 110, the split-type microwave oven 100 may heat the food placed in the microwave-heating resonant cavity 130; when the second microwave shielding member 121 is stored away at the position adjacent to the microwave source component 140, the second microwave shielding member 121 may be stored away, thus improving the space utilization.

As shown in FIGS. 4 and 5, the second housing assembly 120 further includes a wave-transmitting material member 122, the wave-transmitting material member 122 is disposed on the lower surface of the second microwave shielding member 121 to define an accommodating cavity 123 together with the second microwave shielding member 121, and the electromagnetic waveguide 144 is located in the accommodating cavity 123. A shape of the wave-transmitting material member 122 may be substantially similar to a shape of the second microwave shielding member 121, and a lower end of the wave-transmitting material member 122 is connected to the lower end of the second microwave shielding member 121, such that the cavity component may have a compact structure. The electromagnetic waveguide 144 may guide the microwave into the accommodating cavity 123, the microwave may enter the microwave-heating resonant cavity 130 after passing through the wave-transmitting material member 122, and then the food placed in the microwave-heating resonant cavity 130 may be heated. In addition, the wave-transmitting material member 122 may further evenly diffuse the microwave into the heating resonant cavity 130, such that the heated object 400 may be evenly heated to ensure the heating effect of the split-type microwave oven 100, and thus the use requirement of the user may be satisfied.

In order to make the structure of the split-type microwave oven 100 more compact, as shown in FIGS. 4 and 5, the first microwave shielding member 110 may be embedded in the supporting member 300. Certainly, the connection form between the first microwave shielding member 110 and the supporting member 300 is not limited to this. For example, the first microwave shielding member 110 may also be disposed on a surface of the supporting member 300, such that types of the split-type microwave oven 100 may be diversified, and thus the use requirements of different users may be satisfied.

In order to further improve the safety of the split-type microwave oven 100 and reduce the possibility of microwave leakage between the second microwave shielding member 121 and the first microwave shielding member 110, the first microwave shielding member 110 may be provided with a first clip member (not shown), and the second microwave shielding member 121 may be provided with a second clip member (not shown) configured to be fitted with the first clip member. Thus, the first microwave shielding member 110 may be firmly connected to the second microwave shielding member 121 through the fitting of the first clip member and the second clip member, so as to avoid the microwave leakage between the first microwave shielding member 110 and the second microwave shielding member 121.

According to some embodiments of the present disclosure, at least one of the first microwave shielding member 110 and the second microwave shielding member 121 is a metal member. Thus, a production cost may be saved.

According to some embodiments of the present disclosure, as shown in FIGS. 1 to 5, in order to facilitate the fitting of the second microwave shielding member 121 and the first microwave shielding member 110 to define the microwave-heating resonant cavity 130, the second microwave shielding member 121 may have a hemispherical or cuboid shape which is hollow and has an open bottom, such that the appearance of the split-type microwave oven may be diversified, and thus aesthetic needs of different users may be satisfied. For example, as shown in FIGS. 4 and 5, the upper surface of the first microwave shielding member 110 may be formed as a plane, such that when the lower end of the second microwave shielding member 121 is fitted with the first microwave shielding member 110, the microwave-heating resonant cavity 130 for heating food may be defined.

According to some embodiments of the present disclosure, as shown in FIGS. 1 to 3, the microwave shielding and choking member 150 is disposed in a remaining portion of the upper surface of the first housing assembly 105. Herein, "a remaining portion of the upper surface of the first housing assembly 105" refers to a portion of the upper surface of the first housing assembly 105 located outside the microwave-heating resonant cavity 130. Further, the microwave shielding and choking member 150 is formed as an annular member, which is hollow and has an opening 151 in a top thereof. When the second microwave shielding member 121 is fitted with the microwave shielding member 110, the lower surface of the second microwave shielding member 121 encloses the opening 151.

For example, as shown in FIGS. 1 to 3, the microwave shielding and choking member 150 is formed as an annular groove in the upper surface of the first microwave shielding member 110, the opening 151 of the annular groove faces upward (i.e. "up" shown in FIGS. 1 to 3), and the lower end of the second microwave shielding member 121 extends towards the outside of the microwave-heating resonant cavity 130 to form a flanging 124. When the second microwave shielding member 121 defines the microwave-heating resonant cavity 130 together with the first microwave shielding member 110, a lower end surface of the flanging 124 encloses the opening 151 of the annular groove. Thus, the reliability of the microwave shielding and choking member 150 is improved, and also it is convenient for the use of the user.

According to another embodiment of the present disclosure, as shown in FIGS. 4 to 5, the microwave shielding and choking member 150 is disposed on the lower end of the second microwave shielding member 121. Thus, the microwave leakage between the second microwave shielding member 121 and the first microwave shielding member 110 may be effectively prevented. The microwave shielding and choking member 150 is formed as an annular member, which is hollow and has an opening 151 in a bottom thereof. When the second microwave shielding member 121 is fitted with the first microwave shielding member 110, the first microwave shielding member 110 encloses the opening 151. As shown in FIG. 4, the microwave shielding and choking member 150 has a substantially rectangular section, and the opening 151 faces the first microwave shielding member 110. Thus, the structure of the microwave shielding and choking member 150 may be simplified, and also the microwave leakage may be effectively prevented.

In addition, the detection device may be configured as a sensor for detecting an amount of microwaves outside the microwave-heating resonant cavity 130. Thus, the production cost may be saved, and the competitiveness of products may be improved. It should be noted that the structure of the detection device is not limited to this. For example, the detection device may include an emitter for emitting a microwave signal and a receiver for receiving a standing wave. When the second microwave shielding member 121 is fitted with the first microwave shielding member 110 to define the microwave-heating resonant cavity 130, the emitter emits the microwave signal into the microwave-heating resonant cavity 130, and the receiver is used to receive the reflected standing wave. If the microwave signal emitted by the emitter is same with the microwave signal received by the receiver, it is proved that there is no microwave leakage; otherwise, it is proved that there is the microwave leakage. Thus, the detection device may accurately detect whether the microwave leakage occurs at the microwave-heating resonant cavity 130, such that the safety of the split-type microwave oven 100 is improved, and the use requirement of the user is satisfied.

In addition, as shown in FIGS. 1 to 3, in order to facilitate removing or placing the second housing assembly 120 by the user, the second housing assembly 120 may be provided with a handle 125. For example, as shown in FIGS. 1 to 3, the handle 125 may be provided to an upper portion of the second housing assembly 120. In an embodiment of the present disclosure, the power source 142 may be configured as a magnetron power source 142. Certainly, the type of the power source 142 is not limited to this. For example, the power source 142 may also be a semiconductor power source 142. Thus, the power source 142 may be suitable for split-type microwave ovens 100 of different models, and the use requirements of different users may be satisfied.

In the specification, it is to be understood that terms such as "upper," "lower," "vertical," "horizontal," "top," "bottom," "inner," "outer," "axial," "radial," and "circumferential" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations.

Reference throughout this specification to "an embodiment," "some embodiments," "an example," "a specific example," or "some examples," means that a particular feature, structure, material, or characteristic described in connection with the embodiment or example is included in at least an embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, without conflicting, various embodiments or examples or features of various embodiments or examples described in the present specification may be combined by those skilled in the art.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A split-type microwave oven, comprising:

a first housing assembly and a second housing assembly, wherein the second housing assembly is detachably disposed on the first housing assembly, the first housing assembly is configured to be embedded in a supporting member or movably disposed on the support member and is provided with a first microwave shielding member, the second housing assembly is provided with a second microwave shielding member, and the first microwave shielding member is recessed towards an interior of the first housing assembly to define a groove and is configured to define a microwave-heating resonant cavity together with the second microwave shielding member;

a microwave source component mounted in the first housing assembly, wherein the microwave source component comprises a control unit, a power source, an electric power supply and an electromagnetic waveguide, the electromagnetic waveguide is configured to guide a microwave into the microwave-heating resonant cavity, the control unit, the electric power supply and the electromagnetic waveguide are connected to the power source respectively;

a microwave shielding and choking member located outside the microwave-heating resonant cavity and configured to prevent a microwave leakage when the first microwave shielding member defines the microwave-heating resonant cavity together with the second microwave shielding member; and a carrying plate disposed at an opening of the groove and fitted with a side wall of the groove to define an enclosed cavity, wherein a portion of the electromagnetic waveguide is located in the enclosed cavity.

2. The split-type microwave oven according to claim 1, wherein the first microwave shielding member is configured to be embedded in the supporting member or disposed on a surface of a supporting member.

3. The split-type microwave oven according to claim 1, wherein the first microwave shielding member is provided with a first clip member, and the second microwave shielding member is provided with a second clip member configured to be fitted with the first clip member.

4. The split-type microwave oven according to claim 1, wherein at least one of the first microwave shielding member and the second microwave shielding member is a metal member.

5. The split-type microwave oven according to claim 1, wherein the second microwave shielding member is configured to have a hemispherical or cuboid shape which is hollow and has an open bottom.

6. The split-type microwave oven according to claim 1, wherein the microwave shielding and choking member is disposed in a remaining portion of an upper surface of the first housing assembly, the microwave shielding and choking member is formed as an annular member which is hollow and has an opening in a top thereof, when the second microwave shielding member is fitted with the first microwave shielding member, a lower surface of the second microwave shielding member encloses the opening.

7. The split-type microwave oven according to claim 1, wherein the microwave shielding and choking member is disposed on a lower end of the second microwave shielding member, the microwave shielding and choking member is formed as an annular member which is hollow and has an opening in a bottom thereof, when the second microwave shielding member is fitted with the first microwave shielding member, the first microwave shielding member encloses the opening.

8. The split-type microwave oven according to claim 1, wherein the power source is configured as a magnetron power source or a semiconductor power source.

* * * * *